United States Patent [19]

Rahaman

[11] Patent Number: 4,599,750

[45] Date of Patent: Jul. 15, 1986

[54] HAND GRASPING MEMBER FOR A GARMENT

[76] Inventor: Abdul M. Rahaman, 3128 Garfield So., Minneapolis, Minn. 55408

[21] Appl. No.: 763,206

[22] Filed: Aug. 7, 1985

[51] Int. Cl.[4] ..... A41D 27/08; A41D 27/20

[52] U.S. Cl. ..... 2/243 R; 2/23; 2/75; 2/80; 2/249; 2/227; 2/271

[58] Field of Search ..... 2/243 R, 247, 249, 251, 2/23, 52, 94, 271, 100, 101, 139, 140, 227, 230, 223, 80, 75, 79, 86, 305, 253

[56] References Cited

U.S. PATENT DOCUMENTS

| | | | |
|---|---|---|---|
| 644,964 | 3/1900 | Bernstein | 2/253 |
| 1,013,764 | 1/1912 | Goldberg | 2/243 R |
| 1,425,889 | 8/1922 | Meisner | 2/249 |
| 2,582,699 | 1/1952 | Jelaso et al. | 2/75 X |
| 2,663,876 | 12/1953 | Miller et al. | 2/94 X |
| 2,709,815 | 6/1955 | Nelson | 2/247 |
| 3,231,899 | 2/1966 | Seidel | 2/247 |
| 4,411,222 | 10/1983 | Wolfson | 2/305 |
| 4,449,253 | 5/1984 | Hettinger | 2/94 |

*Primary Examiner*—Werner H. Schroeder
*Assistant Examiner*—Andrew M. Falik
*Attorney, Agent, or Firm*—Leo Gregory

[57] ABSTRACT

A hand holding attachment secured to a pair of jeans or a skirt which includes a patch of flexible material attached thereto which may be in the form of a pocket. Secured to the pocket is a strip of material which provides a conveniently reached and grasped hand hold for a child.

2 Claims, 3 Drawing Figures

FIG. 1
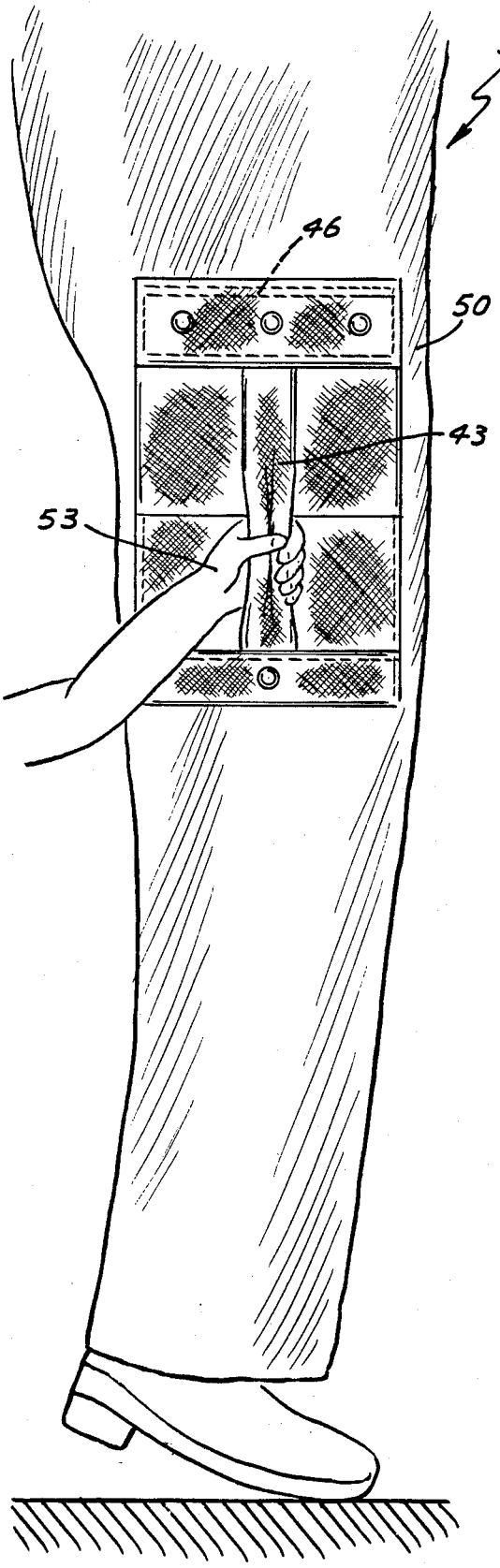
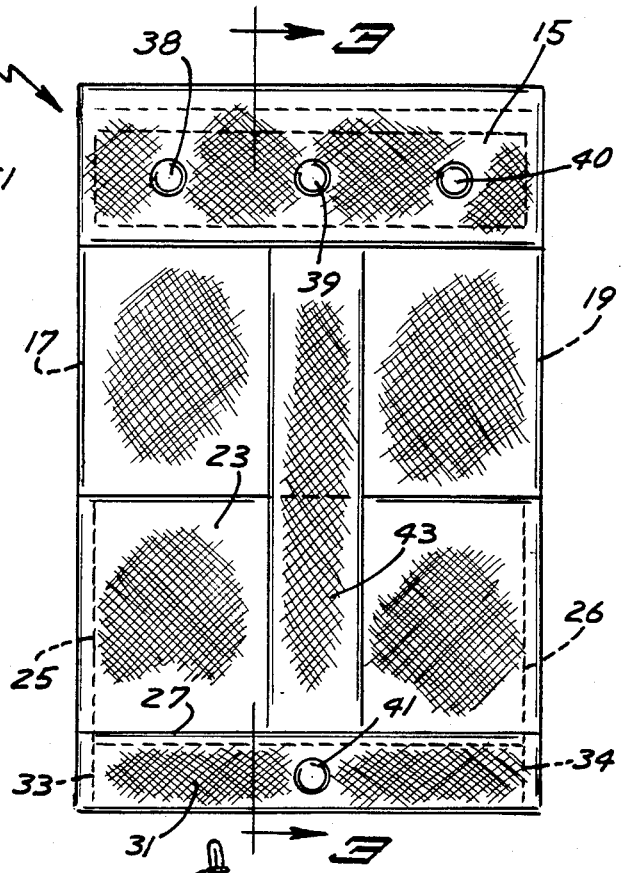
FIG. 2
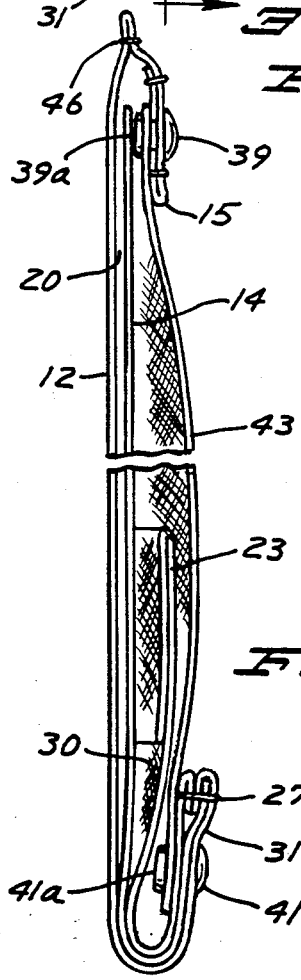
FIG. 3

HAND GRASPING MEMBER FOR A GARMENT

BACKGROUND OF THE INVENTION

1. Field of the Invention

This invention relates to a hand hold attachment to a garment for small children.

2. Brief Description of the Prior Art

When a small child accompanies an adult such as at shopping times, it is desirable to have a hand hold on the child to prevent impulsive wandering and the child in turn is desirous of the assurance of a person which comes through hand holding.

It is not known that any garment is presently available which is particularly designed and constructed for such a purpose. It is desirable that there be such a garment.

SUMMARY OF THE INVENTION

It is an object of this invention to provide a garment as for an adult which embodies therein construction to provide a hand hold for a child.

It is a further object of this invention to design and construct an attachment for a garment such as a pair of jeans or a skirt which includes a conveniently reached and grasped hand hold for a child.

It is more specifically an object of this invention to provide an attachment for a garment such as a pair of jeans or a liesure skirt, the attachment being on the order of a patch of flexible material having a strip secured thereto as to form a hand hold for a child and which may embody pockets for storage purposes.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a view in front elevation showing the invention herein in operative position.

FIG. 2 is a view similar to FIG. 1 showing the invention herein in front elevation; and FIG. 3 is a view in vertical section taken on a line 3—3 of FIG. 2 as indicated.

DESCRIPTION OF A PREFERRED EMBODIMENT

Referring to the drawings, the invention herein consisting of a hand holding attachment which for purposes herein is referred to as a patch and the same is indicated generally by the reference numeral 10.

Said patch as here presented, preferably, is formed of a sheet of sturdy material such as of denim. Said patch as here illustrated consists of a back wall or layer 12 which has an overlying front wall or layer 14 substantially coestensive therewith terminating just under the upper front flap 15 which is formed as a continuation of said back layer.

Said back and front layers are stitched together along their sides with hidden seams at 17 and 19 forming therebetween a pocket 20.

An additional bottom half front layer 23 is stitched at its sides 25 and 26 to said other two layers and across its bottom at 27 to form with said layer 14 a pocket 30. The bottom end portion 31 of said patch is turned up forming a flap which is secured by stitching at its ends as indicated at 33 and 34.

Three female portions of snap fasteners 38, 39, and 40 are secured to the flap 15 spaced thereacross and the male portions of the fasteners 38 and 40, not shown, are secured to the underlying layer 14.

The female portion 41*a* of a snap fastener 41 is secured to the flap 31.

A strap 43, which may be suitably formed of denim, is extending between and under said flaps 15 and 31 to provide an opening therebetween and having secured to its ends the male portions 39*a* and 41*a* of said snaps 39 and 41 which engage said snaps 39 and 41.

Said patch 10 is secured in its operating position, as shown in FIG. 1 by being stitched along its upper edge portion as at 46 to the pant leg 50 of a partially shown pair of jeans 51. The hand hold strap 43 is shown held by a hand 53.

The use of the invention herein is believed to be clearly understood from the drawings taken with the description.

The hand hold provides assurance of reasonable safety for both child and parent and assurance to the parent of the presence of the child. The discipline of being required to hold on the the strap 43 serves very well to quell the curiosity of the child for wandering.

It will of course by understood that various changes may be made in form, details, arrangement and proportions of the parts without departing from the scope of the invention herein which, generally stated, consists in a device capable of carrying out the objects above set forth, in the parts and combinations of parts disclosed and defined in the appended claims.

What is claimed is:

1. A hand holding attachment in connection with a garment, having in combination a patch of material for attachment to a garment, said patch comprises a plurality of layers forming pockets therebetween, a flap at the top and bottom of said patch, a strip of material extending between and under said flaps, and means securing said strip to said flaps and said patch to provide an opening for a hand hold.

2. A hand holding attachment in connection with a garment, having in combination a patch of material for attachment to a garment, a flap at each of a pair of opposed edges of said patch, a strip of material extending between and under said flaps, and means securing said strip to said flaps and said patch to provide an opening for a hand hold.

* * * * *